US008968633B2

(12) United States Patent
Yoon et al.

(10) Patent No.: US 8,968,633 B2
(45) Date of Patent: Mar. 3, 2015

(54) METHOD FOR MANUFACTURING FOOTWEAR LAST, AND FOOTWEAR LAST MANUFACTURED BY THE METHOD

(75) Inventors: Kyoo-Heung Yoon, Busan (KR); Yong-Joo Chon, Busan (KR); Sin-Woo Kim, Busan (KR); Kil-Po Kim, Gimhae (KR); Won-Kwon Lee, Gimhae (KR)

(73) Assignee: NIKE, Inc., Beaverton, OR (US)

( * ) Notice: Subject to any disclaimer, the term of this patent is extended or adjusted under 35 U.S.C. 154(b) by 406 days.

(21) Appl. No.: 12/815,679

(22) Filed: Jun. 15, 2010
(Under 37 CFR 1.47)

(65) Prior Publication Data

US 2011/0030154 A1 Feb. 10, 2011

Related U.S. Application Data

(63) Continuation of application No. 12/299,337, filed as application No. PCT/KR2006/003519 on Sep. 4, 2006, now abandoned.

(30) Foreign Application Priority Data

May 3, 2006 (KR) ..... 10-2006-0039854

(51) Int. Cl.
*B29C 49/06* (2006.01)
*A43D 3/00* (2006.01)

(52) U.S. Cl.
CPC ..... *A43D 3/00* (2013.01)
USPC ..... 264/513; 264/514; 264/515; 264/540

(58) Field of Classification Search
None
See application file for complete search history.

(56) References Cited

U.S. PATENT DOCUMENTS

| | | | | | |
|---|---|---|---|---|---|
| 4,525,134 | A | * | 6/1985 | McHenry et al. | 425/130 |
| 4,617,077 | A | * | 10/1986 | Giese et al. | 156/245 |
| 5,112,560 | A | * | 5/1992 | Moumdjian | 264/516 |
| 5,771,606 | A | * | 6/1998 | Litchfield et al. | 36/29 |

FOREIGN PATENT DOCUMENTS

| | | |
|---|---|---|
| CN | 324829 | 6/1999 |
| JP | 06-075208 | 10/1994 |

OTHER PUBLICATIONS

Korean Office Action issued on Feb. 6, 2007 in Korean Patent No. 10-0725688 with English Translation.
English Translation of Chinese Office Action issue Jul. 2, 1010 in Chinese Application No. 200680054853.7.

* cited by examiner

*Primary Examiner* — Monica Huson
(74) *Attorney, Agent, or Firm* — Plumsea Law Group, LLC

(57) ABSTRACT

Provided is a footwear last, being of a structure where its interior is hollow. The method includes steps of installing a parison for manufacturing a plastic vessel between left/right molds for manufacturing the footwear last, with the left/right molds opened; injecting a last manufacturing material into a tube of the parison; blowing air while closing the left/right molds; molding the material in a temperature of about 400 C to 70° C. and under an injection pressure of about 600 kg/cm$^2$ to 1400 kg/cm$^2$; and completing the last whose interior is hollow.

16 Claims, 8 Drawing Sheets

METHOD FOR MANUFACTURING FOOTWEAR LAST, AND FOOTWEAR LAST MANUFACTURED BY THE METHOD

This application is a Continuation of U.S. application Ser. No. 12/299,337, filed on Nov. 3, 2008, now abandoned.

FIELD OF THE INVENTION

The present invention relates to a method for manufacturing a footwear last, and more particularly, to a method for manufacturing a footwear last using an injection blow molding method, and a footwear last manufactured by the method.

BACKGROUND

In general, a footwear last used for manufacturing a shoe should endure a high pressure and a high heat. Thus, the footwear last is manufactured using an aluminum mold. Highly priced, the footwear last is highly burdened in economy. Metallic, it causes an impact and a noise and in addition, has a difficulty in its manufacture. Heavy in weight, it has a difficulty in treatment.

A conventional plastic last is formed of polyester to solve such a drawback. However, the convention plastic last is not only deformed during a longtime use because of a heat generated in a heating process, but also it causes an inconvenience in that it should be molded in about a double size of a real thing and then, be cut and processed in its manufacture. Further, its recycle is insignificant for the reason of economy and thus, environmental pollution occurs.

A conventional method for manufacturing the plastic last will be briefly described with reference to FIGS. 1A to 1I below.

Referring to FIGS. 1A to 1I, the conventional method includes molding a polyester raw material, cutting (roughing and finishing), finishing both toe and heel ends, painting, a color maker pin process, a stainless pipe process, and checking.

After the injection molding of the polyester raw material, as shown in FIG. 1A, the polyester raw material is roughed such that it has a length and a body-around size larger than a finished last by 10 mm to 15 mm and 30 mm to 35 mm, respectively. After that, as shown in FIG. 1B, the roughed polyester raw material is finished. The finishing is based on" last dimension chart", and is performed according to bottom, toe, and heel gauges and a stick length.

After that, as shown in FIGS. IC and 1D, toe cutting is performed according to the toe gauge and then, heel cutting is performed according to the heel gauge. Next, the heel pin and stainless pipe processes are performed. As shown in FIG. 1E, the heel pin process is a process of driving five heel pins of Ø2.5 at an interval of 5 mm in a straight line, using a drilling machine of Ø2.5. As shown in FIG. 1F, the stainless pipe process is a process of driving a stainless pipe of 12.7Ø to a top surface of the last.

As shown in FIG. 1G, it is checked whether or not the bottom gauge is matched with a toe bottom line. As shown in FIG. 1H, a toe and a heel are checked. As shown in FIG. 1F, the toe and heel of the last are adapted to a front and a rear of a caliper diameter for callipering the length of the last and then, the last is measured in length.

The conventional method has the above many problems. In addition, the conventional method has disadvantages, in particular, that it has a difficulty, needs a long time, and highly costs in manufacture. In addition, because of a grinding work for the processed heel and toe, a worker should check a gauge by manual one by one. Because of a non-uniform work, an accurate and delicate curved surface of the heel cannot be kept.

SUMMARY

Accordingly, the present invention is directed to a method for manufacturing a footwear last, and a footwear last manufactured by the method that substantially obviate one or more of the problems due to limitations and disadvantages of the related art.

An object of the present invention is to provide a method for manufacturing a footwear last using an injection blow molding method.

Another object of the present invention is to provide a method for manufacturing a footwear last in simplicity.

A further another object of the present invention is to provide a footwear last, which is light in weight and whose interior is hollow.

A yet another object of the present invention is to provide a footwear last, in which its recycle is possible, thereby preventing environmental pollution.

A still another object of the present invention is to provide a footwear last and a method for manufacturing the same, for, when a shoe is manufactured, shortening a heat drying time and reducing a chamber staying time owing to a cavity of the footwear last, thereby shortening a work time as well as improving a quality of an adhesive force and the like.

To achieve these and other advantages and in accordance with the purpose of the present invention, as embodied and broadly described, there is provided a footwear last, being of a structure where its interior is hollow. The method includes steps of installing a parison for manufacturing a plastic vessel between left/right molds for manufacturing the footwear last, with the left/right molds opened; injecting a last manufacturing material into a tube of the parison; blowing air while closing the left/right molds; molding the material in a temperature of about 40° C. to 70° C. and under an injection pressure of about 600 kg/cm$^2$ to 1400 kg/cm$^2$; and completing the last whose interior is hollow.

According to the present invention, a footwear last has an advantage in that it is manufactured using an injection blow molding method, thereby not only increasing a simplicity and a productivity but also making the footwear last light and strong, making its manufacture inexpensive, improving a quality, and making its recycle possible and preventing environmental pollution.

DETAILED DESCRIPTION

Hereinafter, preferred embodiments of the present invention will be described in detail with reference to accompanying drawings.

The present invention is to provide a method for manufacturing a footwear last, for promoting the improvements of same product, cost, time, and quality by employing an injection blow molding method, and realizing a competitive product production. For this, a construction of a mold for applying the blow molding method, and the method for manufacturing the footwear last will be described in detail.

In the present invention, a term of "bottom" means a bottom surface of the footwear last. A term of "toe" means a front part of the footwear last. A term of "heel" means a rear part of the footwear last. A term of "stick length" means a total length of the footwear last. A term of "gauge" means a reference line. A term of "heel pin" collectively means a plurality of color maker pins for arbitrarily controlling a height of a rear part of a shoe when the shoe is manufactured using the footwear last.

Hereinafter, an exemplary embodiment of the present invention will be in detail described with reference to the attached drawings.

Figure 1A:
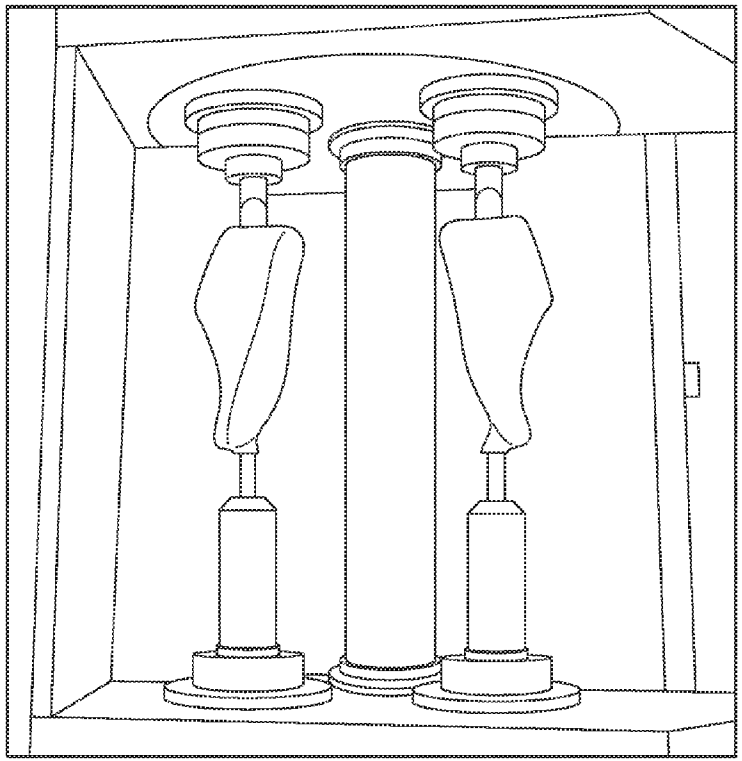
FIGS. 1A to 1I are photographs sequentially illustrating a conventional method for manufacturing a footwear last.
Figure 1B:
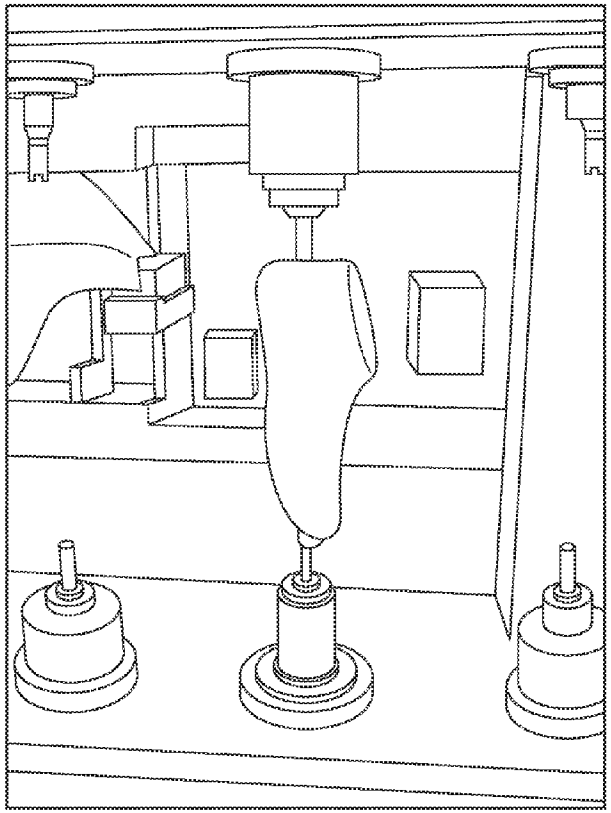
Figure 1C:
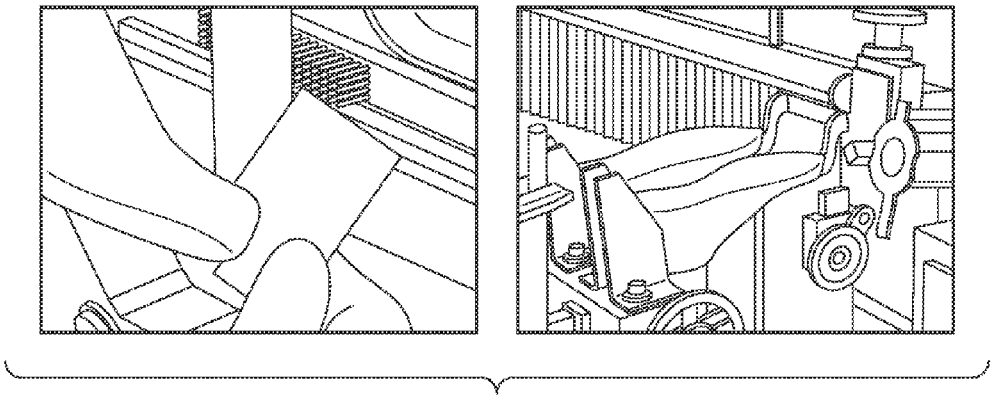
Figure 1D:
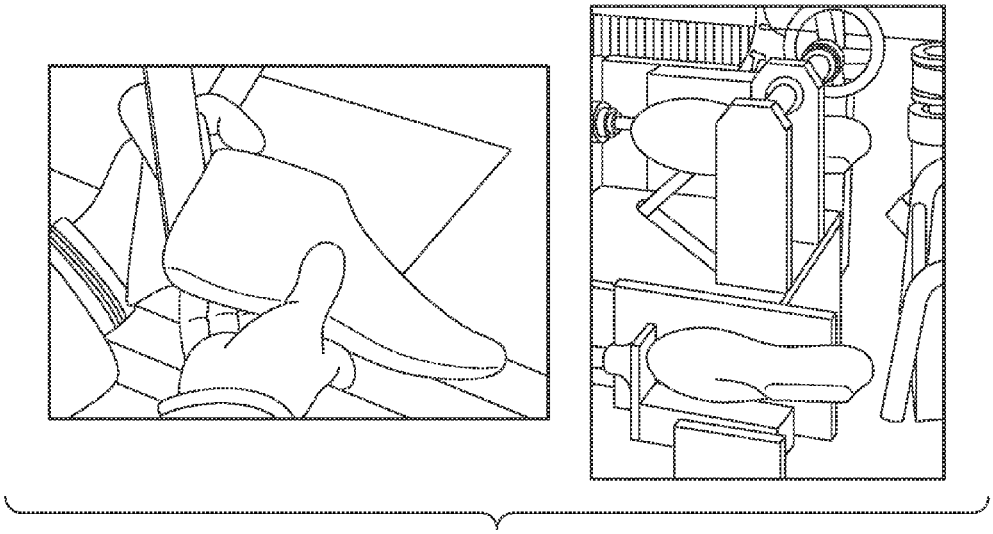
Figure 1E:
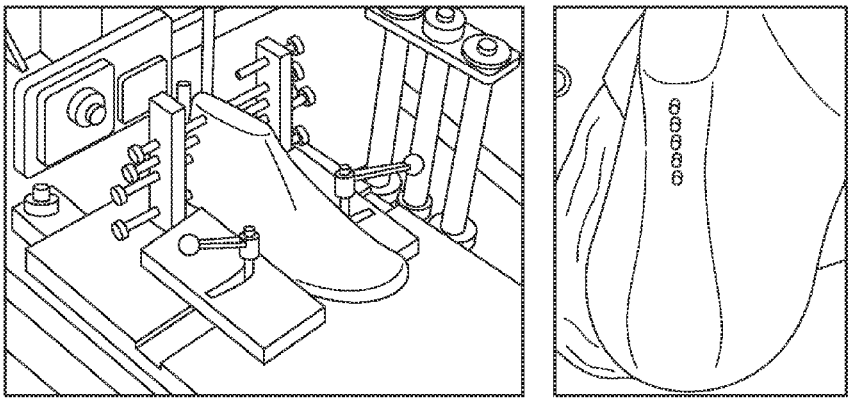
Figure 1F:
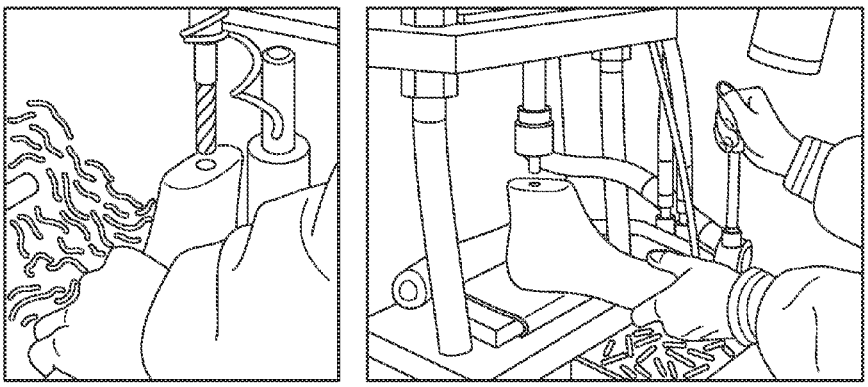
Figure 1G:
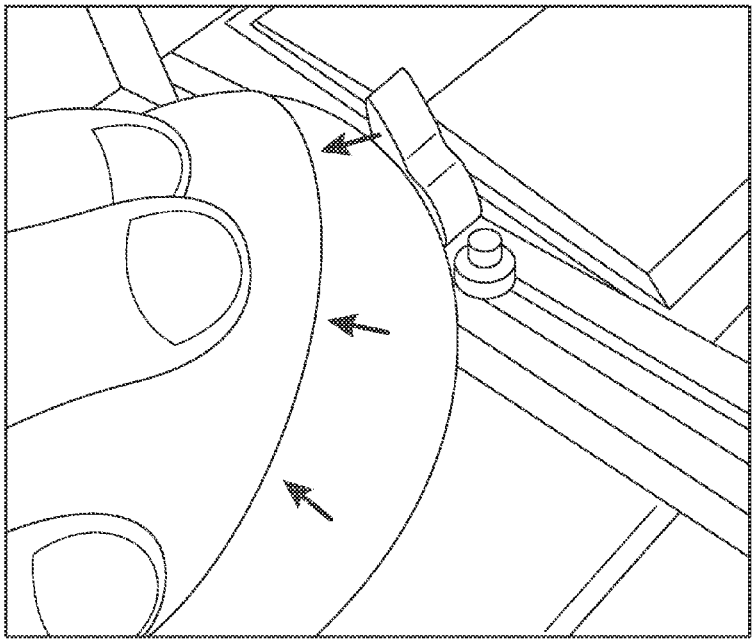
Figure 1H:
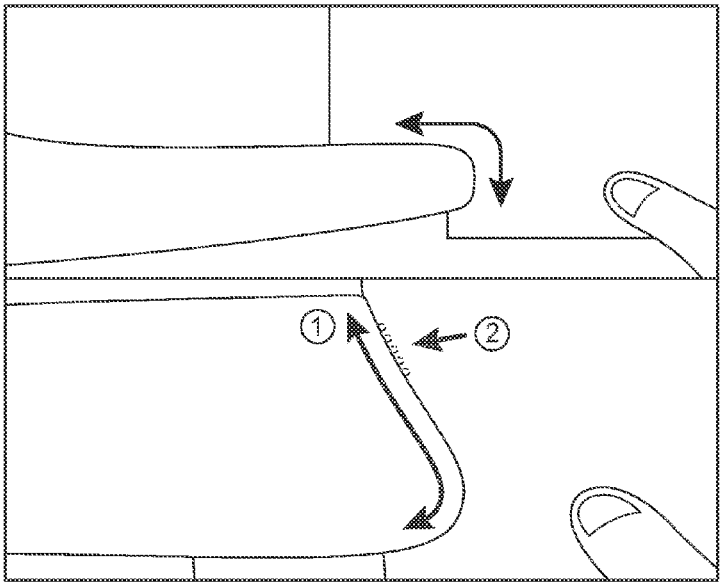
Figure 1I:
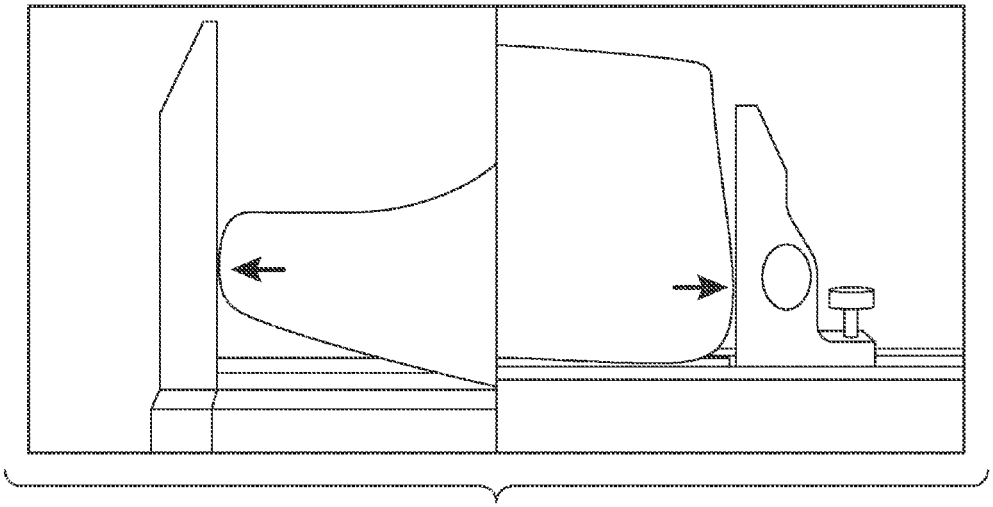
Figure 2:
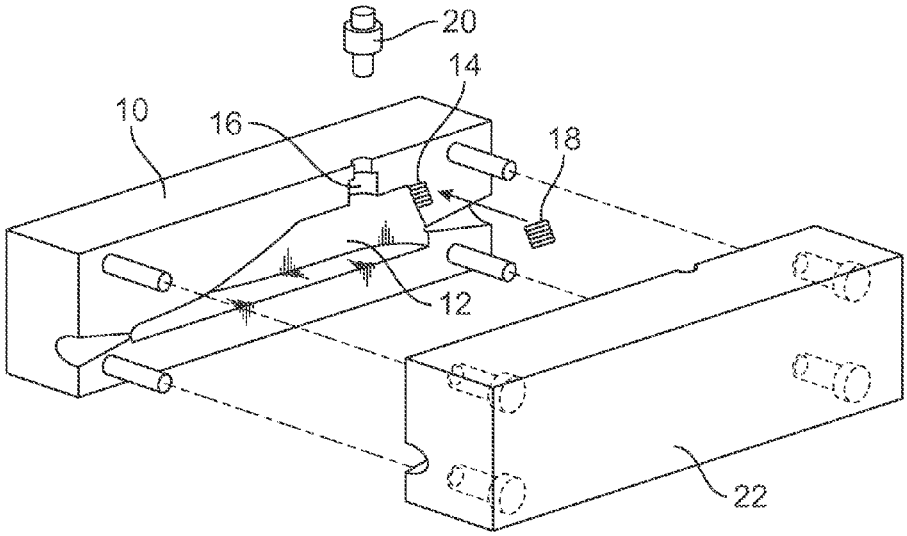
FIG. 2 is a perspective view illustrating a construction of a mold, which is used for manufacturing a footwear last using an injection blow molding method, according to an exemplary embodiment of the present invention.

FIG. 2 is a perspective view illustrating the construction of the mold, which is used for manufacturing the footwear last using the injection blow molding method according to an exemplary embodiment of the present invention. The mold is comprised of a left mold 10 and a right mold 22. After the footwear last is previously diagrammed in shape by a three-dimensional (3D) data work, the left/right molds 10 and 22 are manufactured. In other words, the left/right molds 10 and 22 keep a curved surface based on 3D data as it is. Therefore, the footwear last 200 molded by the left/right molds 10 and 22 can also always keep the curved surface uniform.

Referring to FIG. 2, a cavity 12 having the same shape as the footwear last 200 is provided at one side of the left mold 10. Insertion holes 14 for fitting to the plurality of heel pins 18 are provided at a rear part of the cavity 12. An insertion hole 16 for fitting to a pipe core pin 20 is provided at one upper side of the cavity 12. The pipe core pin 20 fixes the footwear last 200 to a shoe manufacturing jig.

Figure 3A:
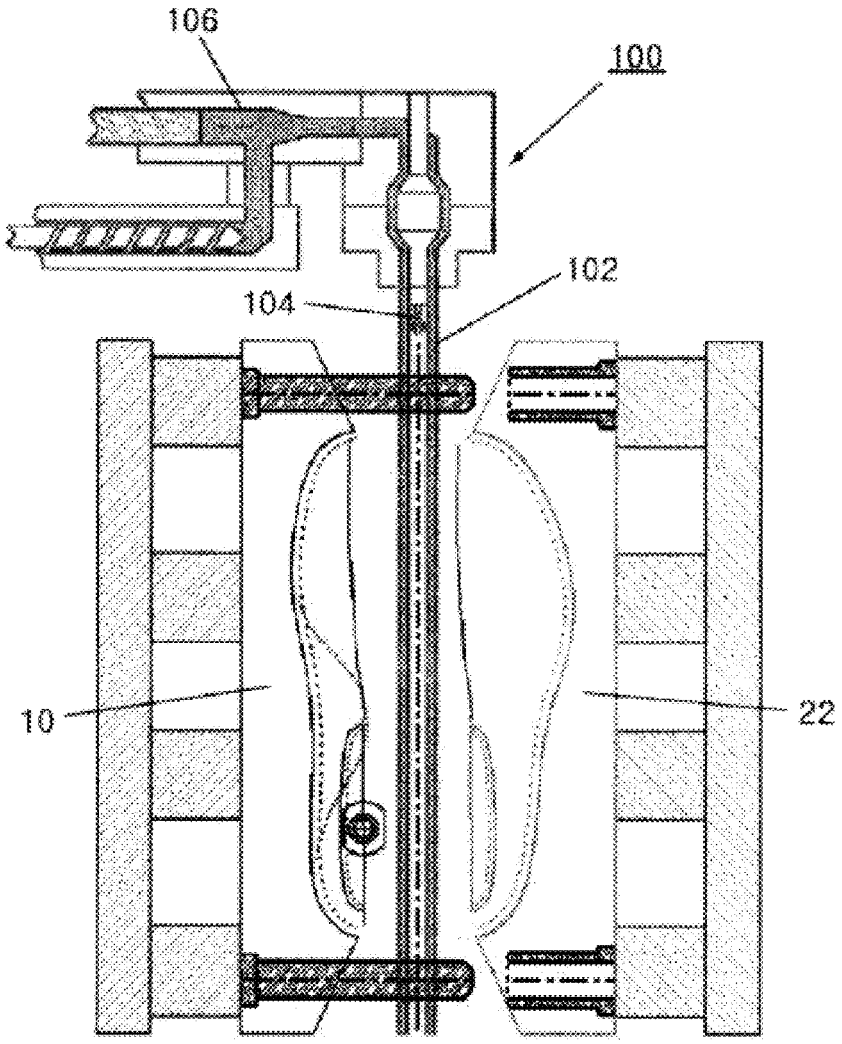
FIGS. 3A and 3B are diagrams sequentially illustrating a method for manufacturing a footwear last by the mold of FIG. 2.
Figure 4:
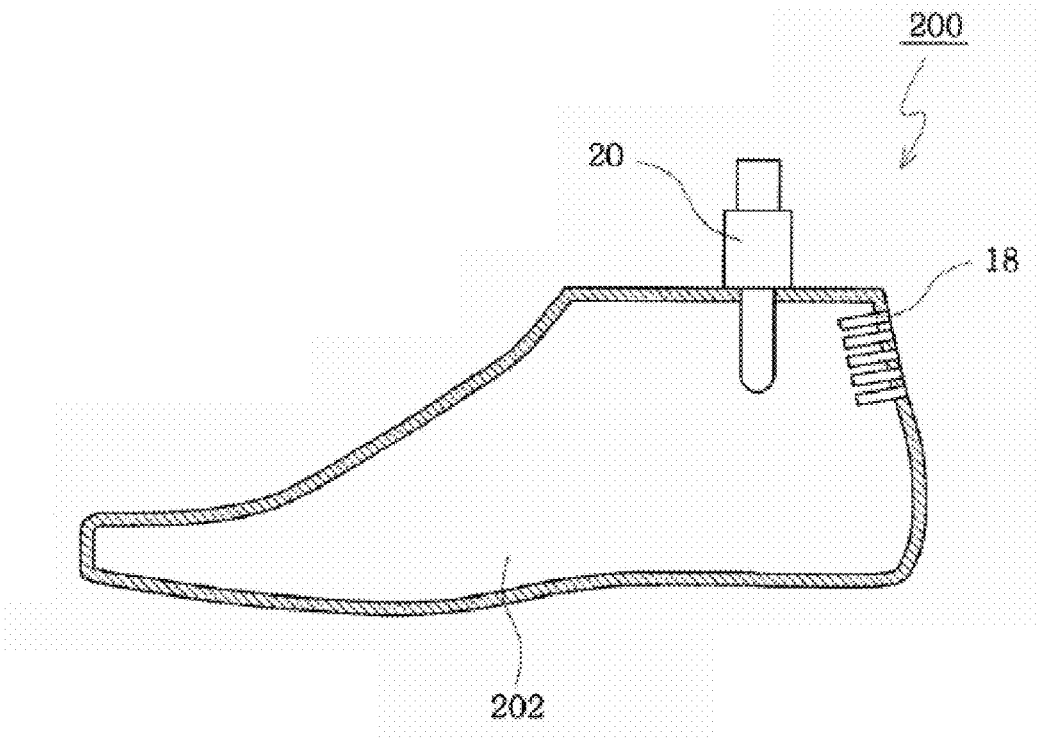
FIG. 4 is a cross-sectional view illustrating a structure of a footwear last manufactured using an injection blow molding method according to an exemplary embodiment of the present invention.

The right mold 22 coupled with the left mold 10 to form one mold also has the same shape as the left mold 10. As shown in FIG. 4, the cavity 12 has the same shape as the footwear last 200. The insertion holes 14 and 16 provide one hole for inserting the heel pin 18 and the pipe core pin 20, respectively. As shown in FIG. 3A, the above constructed left/right molds 10 and 22 are applied to the injection blow molding method. This will be easily understood by the following description.

Figure 3B:
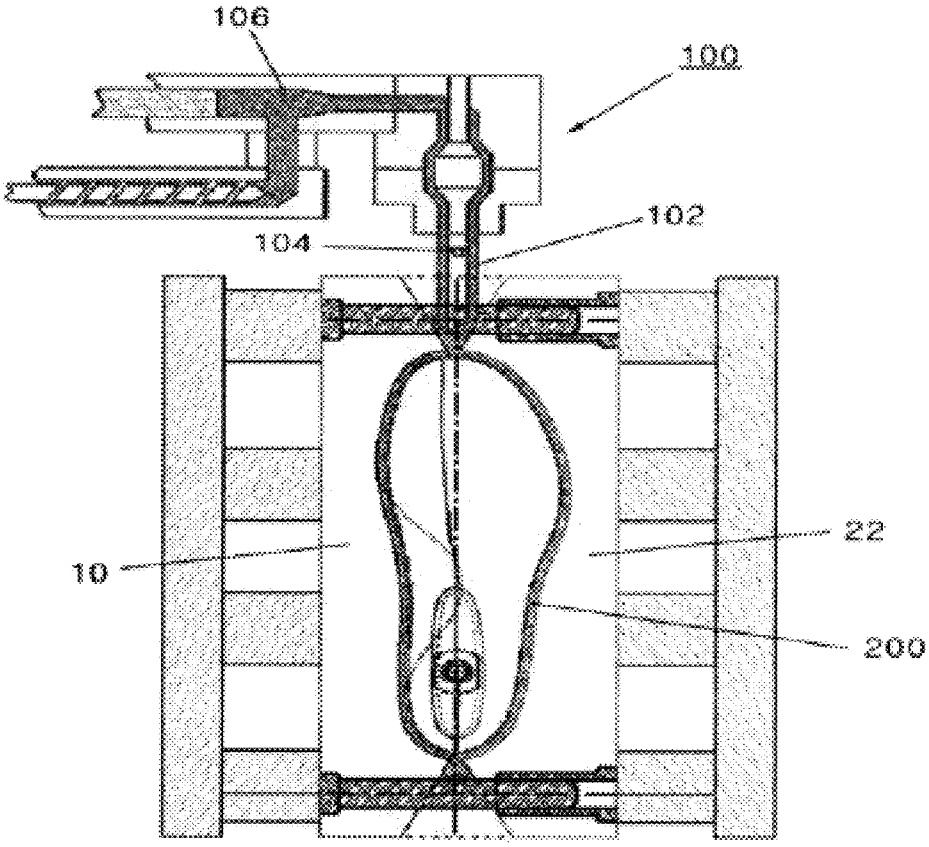

FIGS. 3A and 3B are diagrams sequentially illustrating the method, preferably, the injection blow molding method, for manufacturing the footwear last according to the present invention.

As shown in FIG. 3A, in state where the left/right molds 10 and 22 are opened, a parison injection apparatus 100 for manufacturing a plastic vessel is installed between the opened left/right molds 10 and 22. After that, a gel-state plastic material, for example, high density polyethylene (HDPE), low density polyethylene (LDPE), polypropylene (PP), and polyethylene (PE), is injected into a parison tube 102 through an injection tube 106 of the parison injection apparatus 100.

Next, as shown in FIG. 3B, air is blown through a nozzle 104 provided at a center of the parison tube 102 while the left/right molds 10 and 22 are closed. Next, the injected gel-state plastic material is molded at a predetermined temperature and pressure and then, air blowing stops. Thus, as shown in FIG. 4, the footwear last 200 whose interior is hollow (that is, having a cavity part 202) is manufactured.

The air blowing can be performed even when the left/right molds 10 and 22 are closed. In the above description, blowing position is set to a toe side of the footwear last. However, it is obvious that the blowing position can be set to a heel side of the footwear last.

A concrete condition, for example, general injection pressure or molding temperature, is shown in Table 1.

TABLE 1

| Material | Tg (° C.) | Tm (° C.) | HDT (18.6 kgf) (° C.) | Cylinder Temp. (° C.) | Injection Pressure (km/cm$^2$) | Mold Temp. (° C.) |
|---|---|---|---|---|---|---|
| HDPE | | 135 | | 160-310 | 700-1400 | 40-70 |
| LDPE | | 110 | | 150-310 | 600-1400 | 40-70 |
| PP | −10 | 167 | 60 | 200-280 | 700-1400 | 40-70 |

The inventive manufacturing method is compared with a conventional manufacturing method in detail in Table 2 below.

TABLE 2

| | Conventional Method (PE processing method) | Inventive Method (Injection blow method) |
|---|---|---|
| Price | Expected comparative price: General: 16,000 × 500 pairs = 8,000,000 Won Special: 23,000 × 500 pairs = 11,150,000 Won | 4 cavity 2 size general & special molds Molding cost: 3,000,000 Won Product cost: 600 to 800 Won 3,000,000/500 pairs = 6,000/2 = 3,000 (2 pairs per once injection) Expected Comparative Price : (1,600 per 1 pair + mold depreciation cost 3,000) × 500 pairs = 2,300,000 Won |
| Method | PE Stock machine processing method | Mold blow method |
| Material | Polyester | Polypropylene, Polyethylene |
| Quality | Accurate heel curved surface is difficult to be kept because of non-uniform work, such as gauge check for all products, caused by grinding work of processed heel & toe. | Clean finishing & clean curved surface are kept using gate trimming after injection. Particularly, a smooth surface of a heel part is kept. |
| Production Site | Poor workability because of heavy last | Excellent workability because of light past |
| Manufacturing | Manufacture time per one pair: Machining 10 min., finishing 30 min. (in total, 40 min.) 500 pairs × 40 min = 83 hr. = about 42 days | Mold manufacture time: 10 days, once injection time per 2 pairs: 2 min. (4 cavity) 500 pairs × 2 min./2 = 8.4 hr. = about 2 days |
| Environmental | Impossible recycle | Possible recycle |

FIG. 4 is a cross-sectional view illustrating a structure of the footwear last manufactured using the injection blow molding method according to the present invention. Referring to FIG. 4, the inventive footwear last 200 is of a structure whose interior is hollow, and is integrally provided in entirety.

In other words, the footwear last 200 has the cavity part 202 inside, not being of a conventional structure whose interior is jammed, and keeps a shoe shape (a general last shape) in appearance as it is. Having the structure, the footwear last 200 can be not only greatly light in weight but also can cost a less deal in manufacture and particularly, can improve a workability in comparison with a conventional art.

The plurality of heel pins 18 is inserted into the rear part of the footwear last 200. The pipe core pin 20 is inserted at the one upper side.

Figure 5:
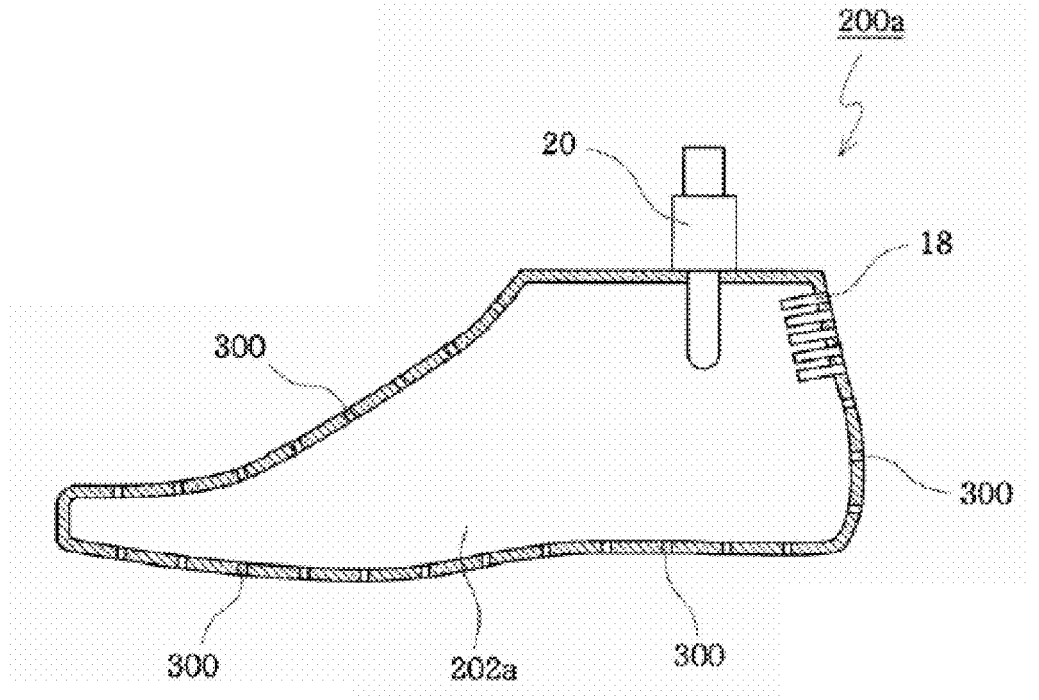
FIG. 5 is a cross-sectional view illustrating a structure of a footwear last manufactured using an injection blow molding method according to another exemplary embodiment of the present invention.

FIG. 5 is a cross-sectional view illustrating a structure of a footwear last manufactured using an injection blow molding method according to another exemplary embodiment of the present invention. The footwear last 200*a* is the same as the footwear last 200 of FIG. 4 in that a heel pin 18 and a pipe core pin are inserted, and a cavity part 202*a* is provided for the footwear last 200*a*. However, the footwear last 200*a* has through-holes 300 around by a predetermined interval. The through-holes 300 are to increase a dissipation of a heat when a shoe is manufactured.

As described above, the present invention has an advantage in that a footwear last is manufactured using an injection blow molding method, thereby not only increasing a simplicity and a productivity but also making the footwear last light and strong, making its manufacture inexpensive, improving a quality, and making its recycle possible and preventing environmental pollution.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

The invention claimed is:

1. A method for manufacturing a footwear last wherein the footwear last is manufactured by an injection blow molding method, the method comprising steps of:

installing a parison for manufacturing a plastic vessel between left/right molds for manufacturing the footwear last, with the left/right molds opened;

injecting a last manufacturing material into a tube of the parison;

blowing air while closing the left/right molds;

molding the material in a temperature of about 40° C. to 70° C. and under an injection pressure of about 600 kg/cm$^2$ to 1400 kg/cm$^2$; and completing the footwear last, the footwear last having a hollow interior;

wherein the footwear last comprises an article in the approximate shape of a human foot, including a heel area, a toe area, and an instep area;

the footwear last is configured to resist pressure and heat without substantially deforming; and wherein a plurality of heel pins is inserted to a rear part of the footwear last, such that the pins extend through the footwear last from an exterior of the footwear last to an interior of the footwear last; and the plurality of heel pins are used to control a height of a rear part of an article of footwear when the an article of footwear is manufactured using the footwear last.

2. The method according to claim 1, wherein the footwear last manufacturing material is selected from the group consisting of HDPE (high density polyethylene), LDPE (low density polyethylene), PP (polypropylene), and PE (polyethylene).

3. The method according to claim 1, wherein the plurality of heel pins are inserted into a rear side of the footwear last.

4. The method according to claim 3, wherein the plurality of heel pins are inserted into in an upper area on the rear side of the footwear last.

5. The method according to claim 1, wherein the plurality of heel pins are inserted into a rear part of the footwear last such that an outer end of each pin is flush with a surface of the hollow footwear last.

6. The method according to claim 1, wherein the plurality of heel pins are aligned such that the length of each pin is perpendicular to a line that is substantially vertical.

7. The method according to claim 1, wherein the plurality of heel pins comprises five heel pins.

8. The method according to claim 1, wherein an outer end of each pin in the plurality of heel pins is marked with a distinguishable color.

9. The method according to claim 1, wherein a pipe core pin is inserted into an upper part of the footwear last, the pipe core pin being configured to attach the last to a jig.

10. The method according to claim 9, wherein the pipe core pin is inserted into an upper side of the footwear last in an area of the upper side adjacent to the rear side of the last.

11. The method according to claim 1, wherein the footwear last has a hollow interior.

12. The method according to claim 11, wherein the footwear last includes a plurality of through-holes, the through-holes extending from an exterior of the footwear last through to the hollow interior of the footwear last.

13. The method according to claim 12, wherein the through-holes are present on at least three sides of the footwear last.

14. The method according to claim 12, wherein the through-holes are spaced at regular intervals, such that the through-holes dissipate heat from the hollow interior of the footwear last.

15. The method according to claim 9, wherein the pipe core pin is inserted through the footwear last, from an exterior of the footwear last to an interior of the footwear last.

16. A method for manufacturing a footwear last wherein the footwear last is manufactured by an injection blow molding method;

wherein the footwear last comprises an article in the approximate shape of a human foot, including a heel area, a toe area, and an instep area; and the footwear last is configured to resist pressure and heat without substantially deforming;

wherein the footwear last has a hollow interior;

wherein the footwear last includes a plurality of through-holes, the through-holes extending from an exterior of the footwear last through to the hollow interior of the footwear last; and wherein the through-holes are spaced at regular intervals, such that the through-holes dissipate heat from the hollow interior of the footwear last.

* * * * *